US006591079B2

(12) United States Patent
Ota et al.

(10) Patent No.: US 6,591,079 B2
(45) Date of Patent: Jul. 8, 2003

(54) TONER CARTRIDGE AND PRINTER TO WHICH THE TONER CARTRIDGE IS ATTACHED

(75) Inventors: Yukio Ota, Tokyo (JP); Hiroshi Kikuchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/801,501

(22) Filed: Mar. 8, 2001

(65) Prior Publication Data

US 2001/0021327 A1 Sep. 13, 2001

(30) Foreign Application Priority Data

Mar. 9, 2000 (JP) ..... 2000-064516

(51) Int. Cl.[7] ..... G03G 15/08
(52) U.S. Cl. ..... 399/262
(58) Field of Search ..... 399/53, 262, 260, 399/258

(56) References Cited

U.S. PATENT DOCUMENTS 3,954,331 A * 5/1976 Smith ..... 399/106
5,652,947 A * 7/1997 Izumizaki ..... 399/58
6,236,814 B1 * 5/2001 Yago ..... 399/27
6,345,163 B1 * 2/2002 Suzuki et al. ..... 399/61

FOREIGN PATENT DOCUMENTS

JP 8-297405 * 11/1996

* cited by examiner

*Primary Examiner*—Quana M. Grainger
(74) *Attorney, Agent, or Firm*—Akin, Gump, Strauss, Hauer & Feld, L.L.P.

(57) ABSTRACT

A toner cartridge is removably attached to a printer and discharges toner into a hopper of the printer. When the toner is to be discharged into the hopper for a first time after the toner cartridge has been attached to the printer, the toner cartridge discharges a certain amount of toner for immediate printing operations. Thereafter, a toner-discharging mechanism operates to discharge fractions of the toner held in the toner cartridge in succession into the hopper. The printer has a controller and a detector. The detector detects an amount of toner remaining in the hopper. The controller controls the toner-discharging mechanism in accordance with the detection signal of the detector such that the toner in the hopper is replenished depending on the amount of toner consumed. The controller controls the toner-discharging mechanism only when the toner remaining in the hopper is below a threshold.

20 Claims, 8 Drawing Sheets

TONER CARTRIDGE AND PRINTER TO WHICH THE TONER CARTRIDGE IS ATTACHED

BACKGROUND OF THE INVENTION

1. Field of the Invention

The present invention relates to a toner cartridge and a printer to which the toner cartridge is attached.

2. Description of the Related Art

Japanese Patent Publication (KOKAI) No. 63-231469 discloses a method of discharging toner from a toner cartridge into a developing unit, which in turn discharges the toner as a developer material to an electrostatic latent image bearing body of an electrophotographic printer.

The toner cartridge is attached to the developing unit of the printer. The toner cartridge has a shutter provided on the underside thereof. When the shutter is rotated, the toner falls from the toner cartridge into a hopper of the developing unit. Thus, the toner is held in the developer.

Recent printers used in the network place demands on large capacity toner cartridges. With conventional printers, the hopper of the developing unit is full of toner before and/or during printing, resulting in increased toner pressure in the hopper. The increased toner pressure causes poor print results.

SUMMARY OF THE INVENTION

The present invention was made in view of the aforementioned drawbacks of the conventional apparatus.

An object of the invention is to provide a toner cartridge that discharges a certain amount of toner for subsequent immediate printing operations when the toner cartridge is attached to the printer and then discharges fractions of the remaining toner in succession.

Another object of the invention is to provide a toner cartridge in which fractions of toner in the toner cartridge are discharged into a hopper when a toner-low state of the hopper is detected.

A toner cartridge is removably attached to a printer and discharges toner into the hopper of the printer. When the toner is discharged into the hopper for a first time after the toner cartridge has been attached to the printer, the toner cartridge discharges a certain amount of toner for immediate printing operations. Thereafter, a toner-discharging mechanism operates to discharge fractions of the toner held in the toner cartridge in succession into the hopper upon a toner-low signal. The printer has a controller and a detector. The detector detects an amount of toner remaining in the hopper. The controller controls the toner-discharging mechanism in accordance with the loner-low signal, i.e., detection signal of the detector such that the toner in the hopper is replenished in accordance with the amount of toner consumed. The controller controls the toner-discharging mechanism only when the toner remaining in the hopper is below a threshold.

A toner cartridge is removably attached to a printer and discharges toner into a toner hopper. The toner cartridge comprises a first toner chamber and a second toner chamber. When the toner is discharged into the toner hopper for a first time after the toner cartridge has been attached to the printer, the first toner chamber discharges all of the toner therein into the toner hopper. When the toner is discharged into the toner hopper after the first toner chamber has discharged the toner into the toner hopper, the second toner chamber discharges fractions of the toner held therein in succession into the toner hopper.

A toner cartridge has a toner chamber that holds toner therein. The toner cartridge is removably attached to a printer and discharging the toner into a toner hopper of the printer. The toner cartridge has a toner-discharging opening through which the toner is discharged from the toner chamber into the toner hopper. A toner-discharging mechanism is disposed to close the toner discharging-opening and the toner is discharged from the toner chamber through the toner-discharging opening into the toner hopper. The toner-discharging mechanism discharges fractions of the toner held in the toner chamber in succession into the toner hopper.

Another toner cartridge is used with a printer which has a toner hopper for receiving toner from the toner cartridge. The toner cartridge has a toner-discharging opening through which the toner is discharged into the toner hopper and a toner-discharging mechanism disposed to close the toner-discharging opening. The printer includes a controller that controls the toner-discharging mechanism to discharge the toner into the toner hopper only when an amount of toner remaining in the toner hopper is below a threshold value and a printing operation is being performed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

{Construction}

Figure 1:
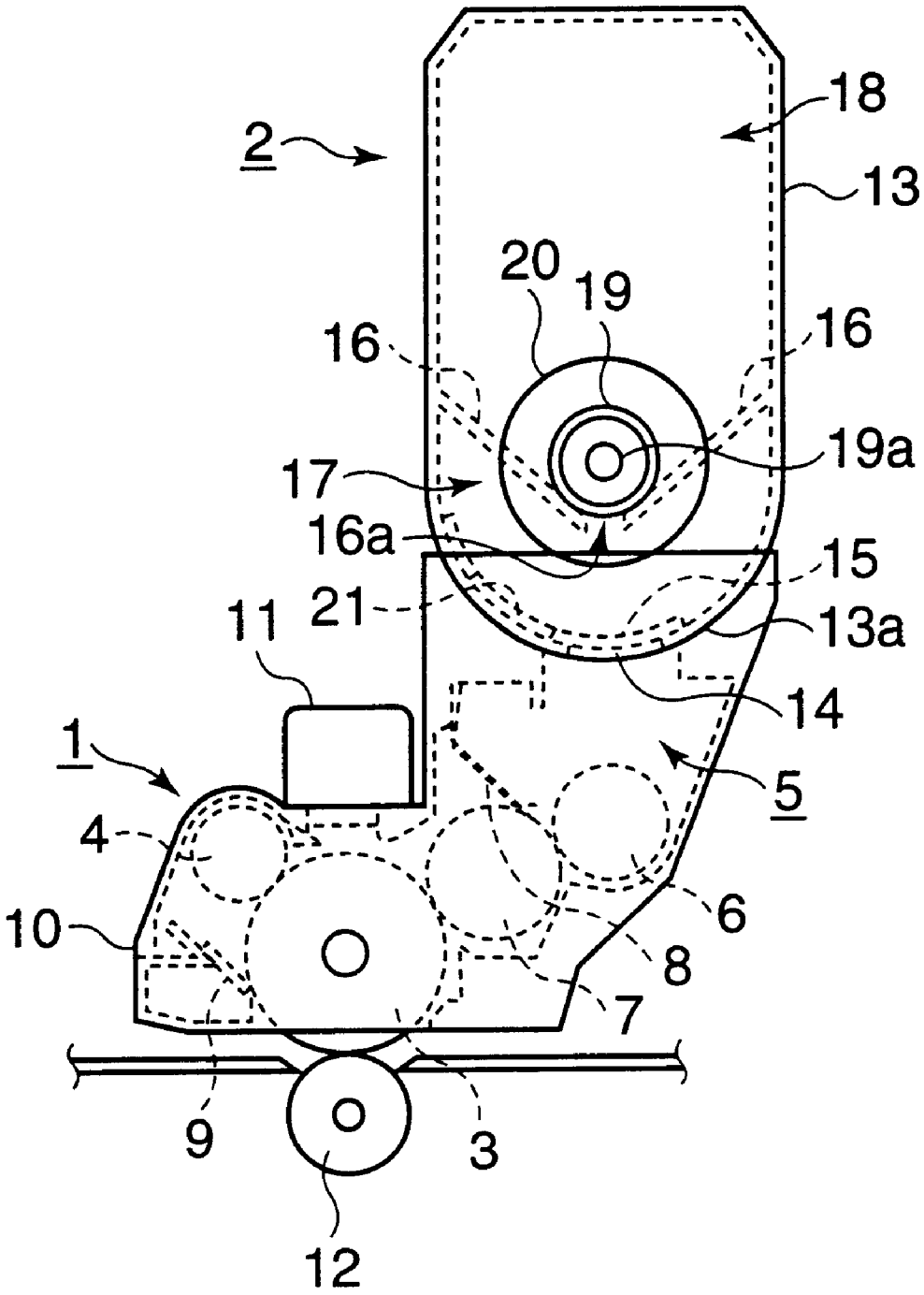
FIG. 1 is a cross-sectional side view of a toner cartridge according to a first embodiment when the toner cartridge has been attached to the developing unit.

FIG. 1 is a cross-sectional side view of a toner cartridge according to a first embodiment when the toner cartridge has been attached to the developing unit.

Figure 2:
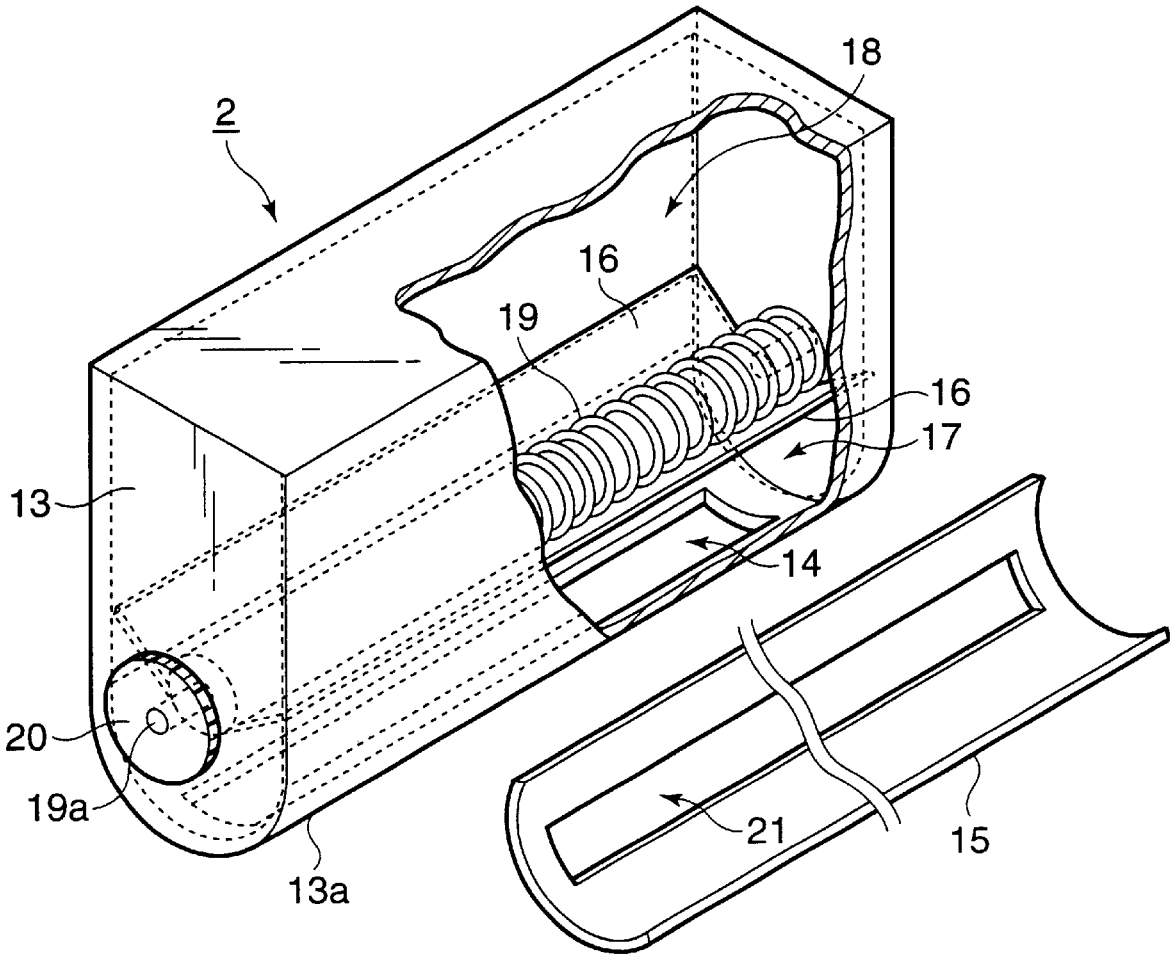
FIG. 2 is an exploded perspective view of the toner cartridge according to the first embodiment.

FIG. 2 is an exploded perspective view of the toner cartridge according to the first embodiment.

The structure of the developing unit 1 and cartridge 2 will be described with reference to FIGS. 1 and 2. Referring to FIGS. 1 and 2, a developing unit 1 is removably attached to an image forming apparatus, not shown, in the form of a printer. The toner cartridge 2 is attached to the developing unit 1 in a later described manner.

The developing unit 1 is covered with a frame 10. A photoconductive drum 3 is disposed in the frame 10 and serves as an image bearing body. Disposed around a photoconductive drum 3 are a charging roller 4, toner hopper 5, toner supplying roller 6, developing roller 7, developing blade 8, and cleaning blade 9. The charging roller 4 charges the surface of the photoconductive drum 3. The toner hopper 5 receives and holds toner, not shown, discharged from the toner cartridge 2. The developing roller 7 receives the toner that is negatively charged and delivered by an agitating bar, not shown, and supplying roller 6. The developing blade 8 serves to uniformly apply the toner to the surface of the developing roller 7. The cleaning roller 9 removes residual toner deposited on the surface of the photoconductive drum 2 after transfer.

An LED head 11 is disposed downstream of the charging roller 4 and upstream of the developing roller 7, and opposes the surface of the photoconductive drum 3. The LED head 11 illuminates the surface of the photoconductive drum 3 in accordance with print data to form an electrostatic latent image. A transfer roller 12 is in pressure contact with the surface of the photoconductive drum 3 and transfers the toner image formed on the photoconductive drum 3 onto a print medium, fed between the drum and the transfer roller 12 by a feed roller, not shown.

Referring to FIG. 2, the toner cartridge 2 has a longitudinally extending hollow frame 13 with an opening 14 formed in a lower portion or bottom portion 13*a* of the frame 13. When the toner cartridge 2 is attached to the developing unit 1, the lower portion 13*a* opposes the hopper 5. The toner in the toner cartridge 2 will fall through the opening 14 into the hopper 5. There is provided a shutter 15 in the frame 13 such that the shutter 15 is rotatable relative to the frame 13 between an opening position and a closing position. FIG. 1 illustrates the shutter 15 at the closing position. The shutter 15 has an opening 21 formed therein. When the shutter 15 moves to the opening position, the opening 21 is aligned with the opening 14 so that the toner in the lower chamber 17 will fall through the opening 14 into the hopper 5. When the shutter 15 moves to the closing position, the opening 21 completely closes the opening 14 so that the toner will not fall into the hopper.

The frame 13 has a partition 16 formed therein. The partition 16 extends along the longitudinally extending frame 13 to define a lower chamber 17 below the partition 16 and an upper chamber 18 above the partition 16. The upper chamber 18 has a larger volume than the lower chamber 17. The partition 16 has an opening 16*a* that extends along the longitudinally extending frame 13 such that the upper chamber 18 and lower chamber 17 communicate with each other through the opening 16*a*. The partition 16 has two downward slopes that define the opening 16*a* therebetween. A loosely wound coil-shaped agitator 19 is rotatably mounted in contact with the two slopes to close the opening 16*a*. The agitator 19 may be of other shapes, for example, the agitator may be a member having meshes formed therein.

The agitator 19 is rotatably supported at the longitudinal ends of the frame 13 and is fixed to short shafts 19*a* and 19*b*. The shafts 19*a* and 19*b* extend in opposite directions through the frame 13 and are rotatably supported by the frame 13. The shaft 19*a* is connected to a gear 20 that is located outside the frame 13. When the toner cartridge 2 is attached to the developing unit 1, the gear 20 meshes with a drive gear, not shown, on the image forming apparatus side. When the remaining toner in the hopper 5 reaches a certain level, the drive gear drives the agitator 19 under the control of a controller, not shown. The agitator rotates to agitate the toner, so that fractions of toner are discharged in succession, that is, the toner is discharged little by little from the upper chamber 18 through the lower chamber 17 into the hopper 5. The amount of toner that is delivered per unit time from the upper chamber 18 into the hopper 5 depends on the rotational speed of the agitator 19; less toner is delivered if the rotational speed is lower and more toner is delivered if the rotational speed is higher. Alternatively, the agitator 19 may be rotated at a constant speed but driven intermittently.

The lower chamber 17 and hopper 5 have the same volume or the lower chamber 17 has a smaller volume than the hopper 5. While the toner cartridge 2 of the first embodiment has two toner chambers 17 and 18, any number of chambers may be used.

When a display indicates to the user that the toner cartridge 2 has reached exhaustion, the user opens an access cover, not shown, of the image forming apparatus and replaces the toner cartridge 2 as shown in FIG. 1. Likewise, when the user attaches a toner cartridge to the image forming apparatus for the first time, the user attaches the toner cartridge in the same manner.

Then, the user rotates a lever, not shown, of the toner cartridge 2 to rotate the shutter 15 so that the opening 14 in the frame 13 of the toner cartridge 2 is aligned with the opening 21 formed in the shutter 15. When the openings 14 and 21 are aligned with each other, all of the toner held in the lower chamber 17 falls into the hopper 5 through the openings 14 and 21. The toner discharged from the lower chamber 17 is enough for immediate printing operations.

{Operation}

Upon power up, the image forming apparatus performs initial setup operations to become ready for printing. Thereafter, the agitator 19 is driven in rotation to deliver the toner into the hopper 5 only when a printing operation is being carried out and the remaining toner in the hopper reaches a certain level.

Thereafter, the toner is discharged little by little from the toner cartridge 2 into the hopper 5 so as not to supply more toner than the hopper 5 can hold. Thus, the toner pressure in the hopper 5 is maintained at a proper level, preventing poor print quality as well as providing a reliable image forming apparatus that prevents print quality from being deteriorated.

Second Embodiment

Elements of a second embodiment similar to those in the first embodiment have been given the same reference numerals and the description thereof is omitted.

{Construction}

Figure 3:
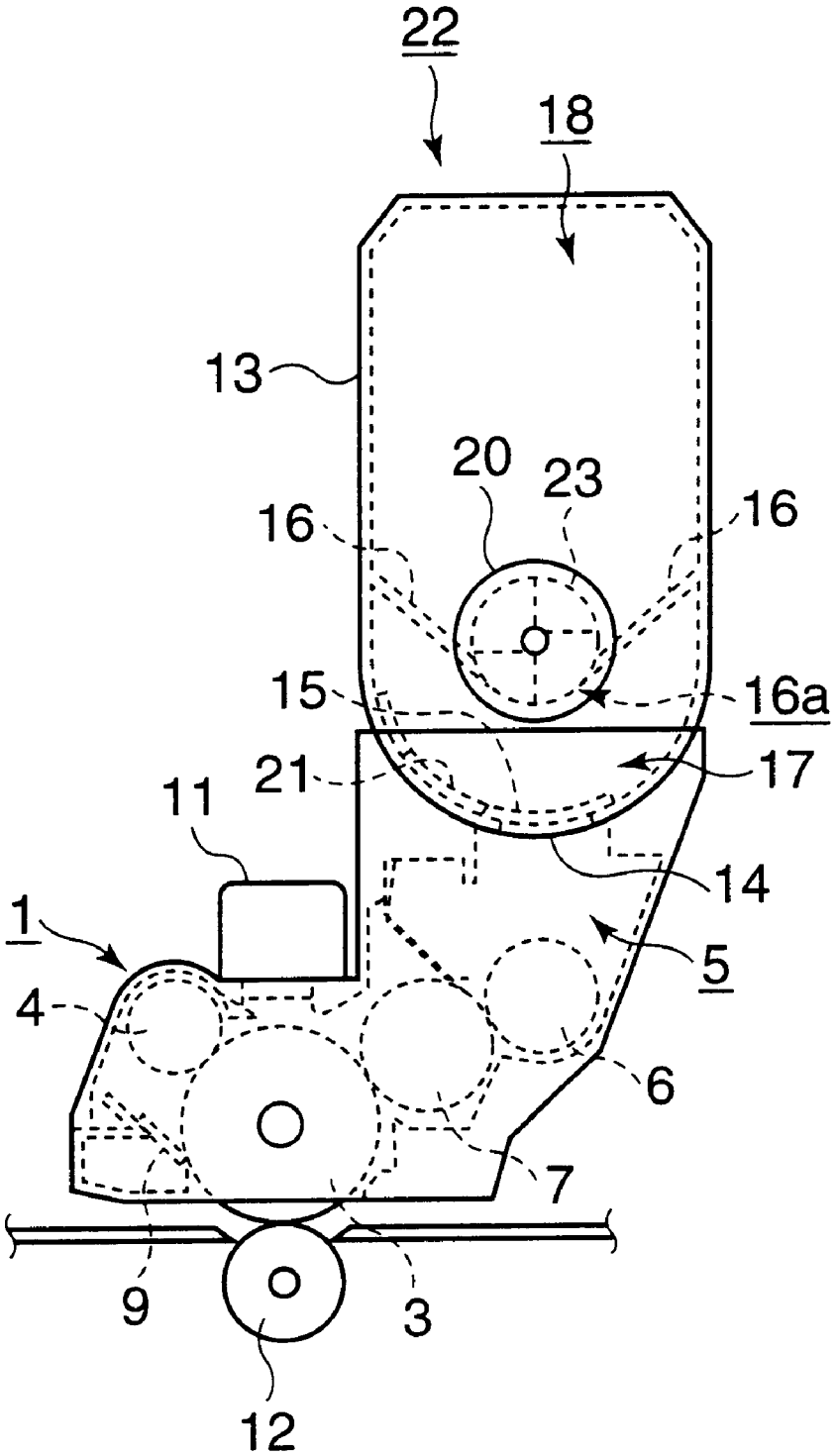
FIG. 3 is a cross-sectional side view of a toner cartridge of the second embodiment when it is attached to the developing unit.

FIG. 3 is a side view of a toner cartridge of the second embodiment when it is attached to the developing unit.

Figure 4:
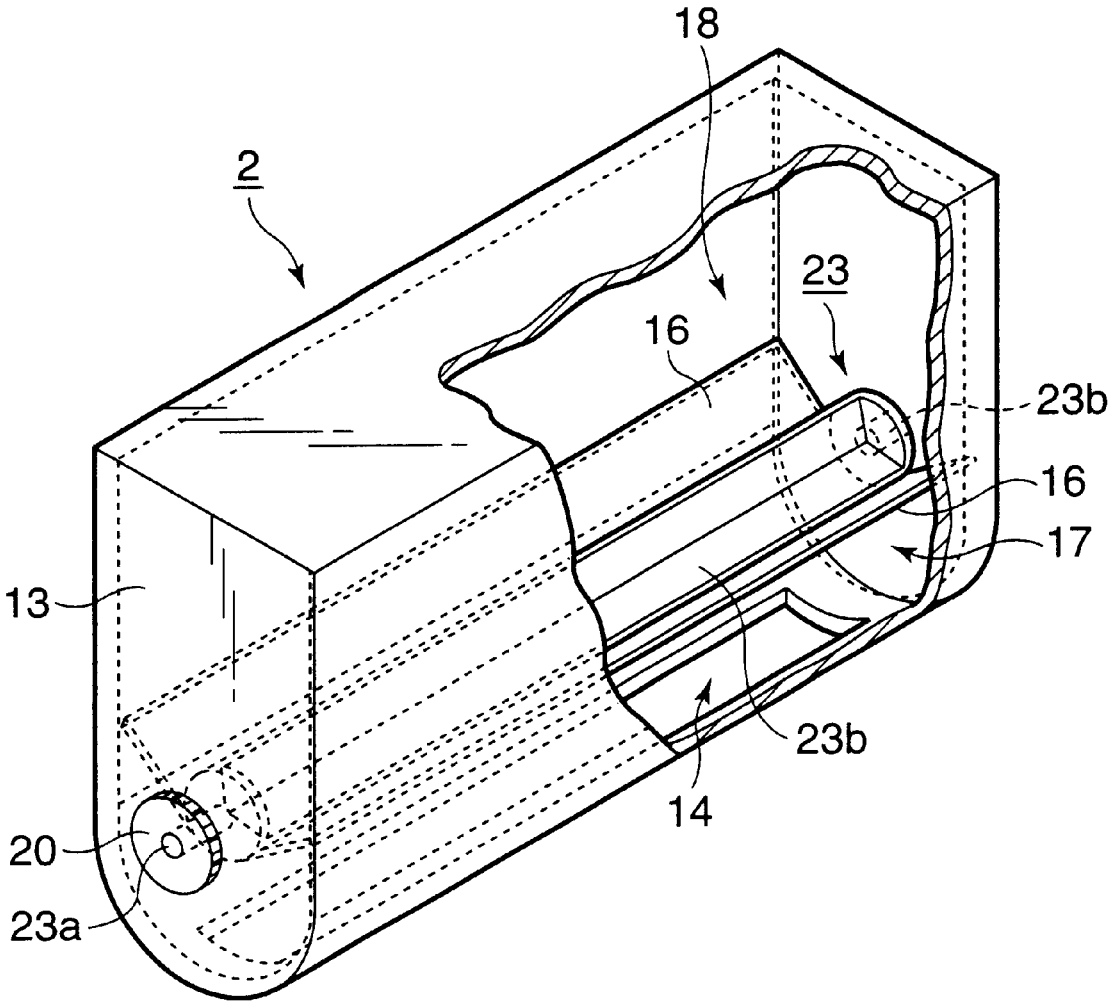
FIG. 4 is a perspective view of the toner cartridge according to the second embodiment.

FIG. 4 is a perspective view of the toner cartridge according to the second embodiment.

Referring to FIGS. 3 and 4, the toner cartridge 22 incorporates a toner-discharging member 23 having two short shafts 23*a* and 23*b* that extend in opposite directions parallel to the generally longitudinally extending frame 13. The toner-discharging member 23 is rotatably supported at its longitudinal ends and disposed to close the opening 16*a* formed in the partition 16. The toner-discharging member 23 has one longitudinal end thereof fixed to a shaft 23*a* that extends through the frame 13 to project outwardly from the frame 13. The shaft 23*a* is fixedly connected to a gear 20.

Figure 5:
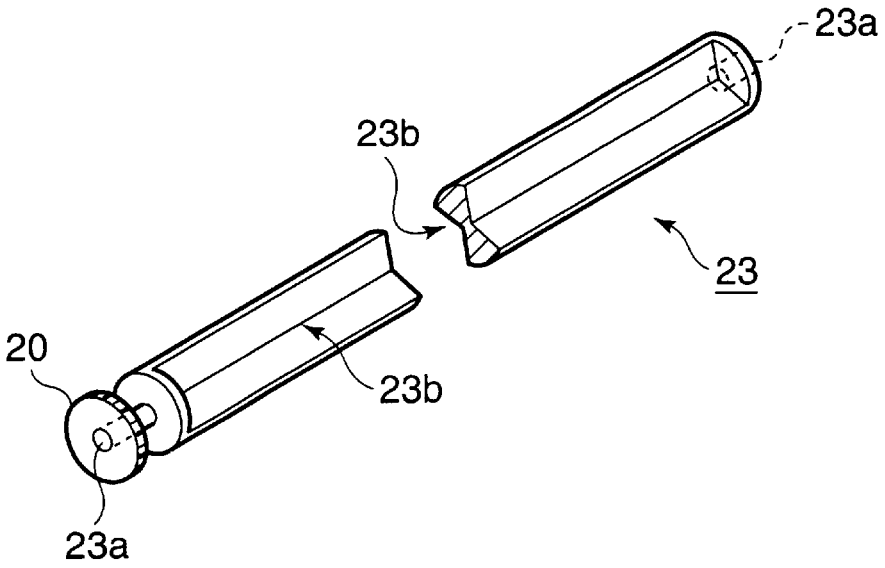
FIG. 5 is a perspective view of a toner-discharging member.

FIG. 5 is a perspective view of the toner-discharging member 23.

As shown in FIG. 5, the toner-discharging member 23 is of a generally cylindrical shape that extends along the opening 16*a,* and has diametrically opposed two toner-holding spaces 23*b* having a V-shaped cross section. While the toner-discharging member 23 according to the second embodiment has only two toner-holding spaces but any number of toner-holding spaces may be employed.

Just as in the first embodiment, the gear 20 meshes with a drive gear, not shown, of a drive mechanism provided on the image forming apparatus side. The drive gear is driven in rotation by a later described stepping motor 42. Instead of the stepping motor, the drive mechanism may use an ordinary motor with a clutch, not shown, and detecting means, not shown, for detecting the number of rotations of the toner-discharging member 23.

{Operation}

A control system of the second embodiment will be described in terms of detection of the amount of toner remaining in the hopper 5 and control of rotation of the toner-discharging member 23.

Figure 6:
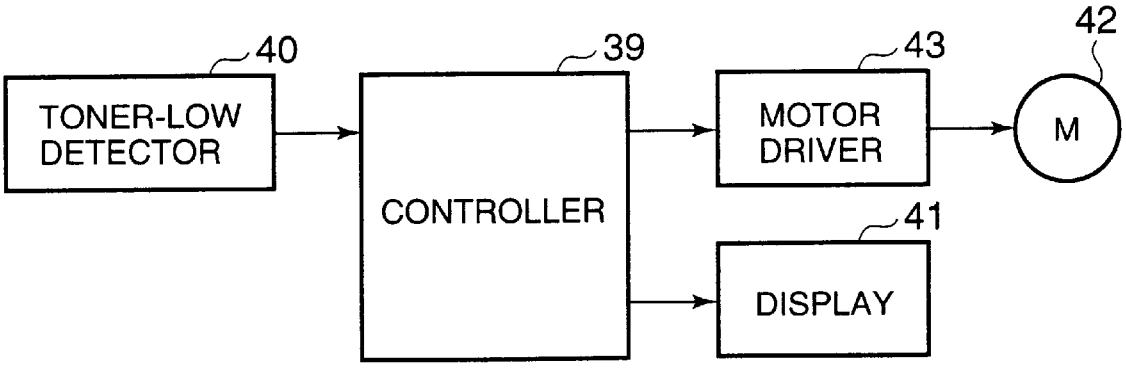
FIG. 6 is a block diagram illustrating the control mechanism of the second embodiment.

FIG. 6 is a block diagram illustrating the control system of the second embodiment.

Referring to FIG. 6, a controller 39 controls overall operations of the image forming apparatus. The controller 39 is connected to a toner-low detector 40 and receives the output of the toner-low detector 40 that indicates a toner-low state where the amount of toner remaining in the hopper 5 is below a certain value. The controller 39 is also connected to a display 41 and a motor driver 43 that drives the stepping motor 42. When the toner-cartridge 22 has reached exhaustion, the controller 39 causes the display 41 to display a message that prompts the user to replace the toner cartridge 22. When the toner-low detector 40 detects the toner-low state, the controller 43 controls the motor driver 43 to drive the stepping motor 42 in rotation. Thus, the stepping motor 42 controllably drives the gear 20 in rotation. The rest of the construction is the same as that of the first embodiment and the description thereof is omitted.

The operation of discharging toner from the toner cartridge 22 to the developing unit 1 will now be described.

When the display 41 indicates to the user that the toner cartridge 22 has reached exhaustion, the user opens an access cover, not shown, of the image forming apparatus and replaces the toner cartridge 22 as shown in FIG. 1. Likewise, when the user attaches a toner cartridge 22 to the image forming apparatus for the first time, the user attaches the toner cartridge 22 in the same manner.

Then, the user rotates a lever, not shown, of the toner cartridge 22 to rotate the shutter 15 so that the opening 14 in the frame 13 of the toner cartridge 22 is aligned with the opening 21 formed in the shutter 15. FIG. 3 illustrates the shutter 15 when the shutter 15 closes the opening 14. When the openings 14 and 21 are aligned with each other, all of the toner held in the lower chamber immediately falls from the lower chamber 17 into the hopper 5 through the openings 14 and 21.

Upon power up, the image forming apparatus performs initial setup operations to become ready for printing. Thereafter, if the toner-low detector 40 detects the toner-low state, then the toner-low detector 40 provides a detection signal to the controller 39. As long as the controller 39 is receiving the detection signal, the controller 39 controls the motor driver 43 to drive the stepping motor 42 to rotate the gear 20. Thus, the motor drives the toner-discharging member 23 in rotation. When the V-shaped space 23*b* is oriented upward, the space 23*b* receives toner therein from the upper chamber 18. When the V-shaped space 23*b* is oriented downward as the toner-discharging member 23 rotates, the toner in the V-shaped space falls through the lower chamber 17 into the hopper 5. When the toner-low detector 40 detects that the toner-low state has been removed, the controller 39 controls the motor driver 43 to stop driving the stepping motor 42. Thus, the stepping motor 42 stops so that the toner-discharging member 23 is prevented from further rotating. Thus, the toner is no longer discharged. The aforementioned operation is repeated to supply toner into the hopper 5 as the toner in the hopper is consumed.

The rotation of the toner-discharging member 23 may also be controlled in some other way. For example, the controller 39 estimates an amount of toner consumed based on a total amount of data that has been printed since the toner was supplied from the toner cartridge into the hopper 5 last time. When the controller 39 determines that the amount of toner consumed exceeds a certain value, a predetermined amount of toner is discharged into the hopper 5. An amount of toner that is delivered by the V-shaped space 23*b* at a time is known. Thus, the configuration may be modified such that the toner-discharging member 23 is rotated through a number of rotations in accordance with the amount of toner consumed since the toner was supplied from the toner cartridge into the hopper 5 last time. The toner-discharging member 23 is rotated through more rotations if the amount of printed data is large than if the amount of printed data is small.

The second embodiment offers the same advantages as the first embodiment.

Third embodiment

{Construction}

Figure 7A:
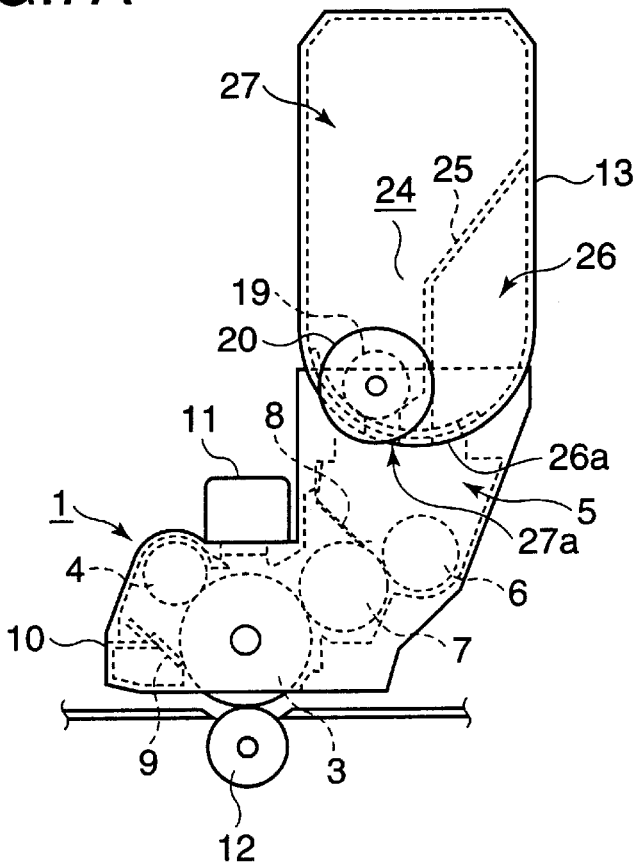
FIG. 7A is a cross-sectional side view illustrating a toner cartridge according to a third embodiment when the toner cartridge is mounted to the developing unit.

FIG. 7A is a cross-sectional side view illustrating a toner cartridge 24 according to a third embodiment when the toner cartridge is mounted to the developing unit.

Figure 7B:
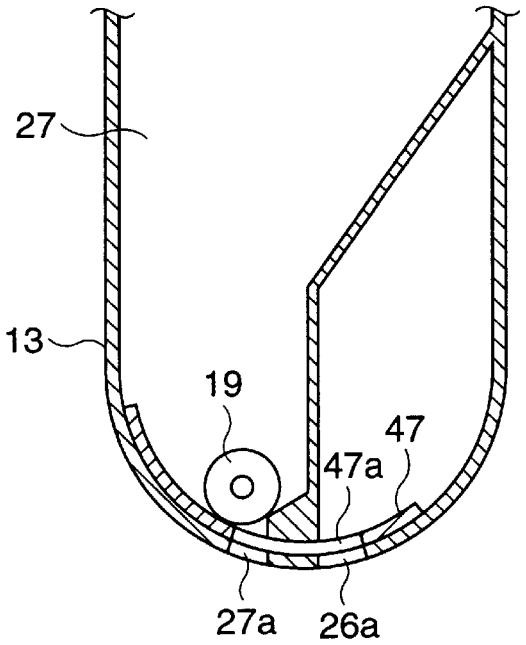
FIGS. 7B and 7C are fragmentary cross-sectional side views of a relevant portion of FIG. 7A.
Figure 7C:
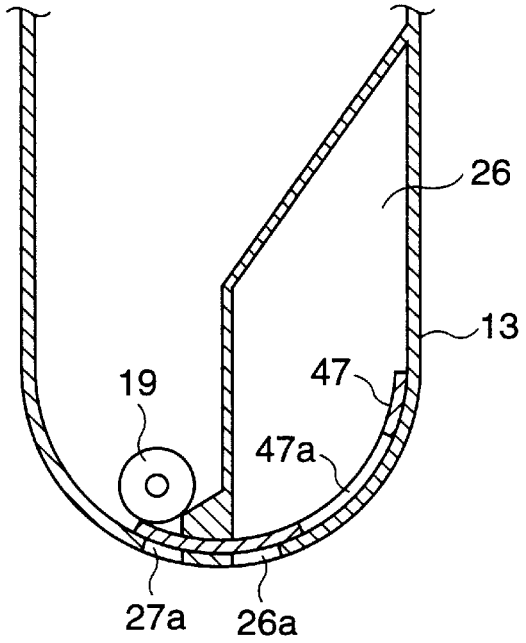

FIGS. 7B and 7*c* are fragmentary cross-sectional side views of a relevant portion of FIG. 7A.

Referring to FIG. 7A, a partition 25 divides an inner space of the toner cartridge 24 into a large chamber 27 and a small chamber 26. The large chamber 27 and the small chamber 26 are aligned substantially horizontally. The small chamber 26 has an opening 26*a* that faces the hopper 5. The large chamber 27 has an opening 27*a* that faces the hopper 5. The opening 27*a* is slightly larger than the opening 26*a*. The agitator 19 of the same construction as the first embodiment is disposed above the opening 27*a* to close the opening 27*a*.

The toner cartridge 24 has a shutter 47 of substantially the same structure as the shutter 15 of the first embodiment. The shutter 47 differs from the shutter 15 in that an opening 47*a* is larger than the opening 21. The rest of the construction is much the same as that of the first embodiment and the description thereof is omitted.

The toner cartridge 24 will be described in terms of the operation in which the toner cartridge discharges toner into the developing unit 1.

When a display, not shown, indicates to the user that the toner cartridge 24 has reached exhaustion, the user opens an access cover, not shown, of the image forming apparatus and replaces the toner cartridge 24 as shown in FIG. 7. Likewise, when the user attaches a toner cartridge to the image forming apparatus for the first time, the user also attaches the toner cartridge in the same manner.

At this moment, the shutter 47 is at a closing position relative to the frame 13 as shown in FIG. 7C where the toner is held in the toner cartridge. Then, the user rotates a lever, not shown, of the toner cartridge 24 to rotate the shutter 47 to an opening position as shown in FIG. 7B where the opening 47*a* overlaps the opening 26*a* and the opening 27*a*. When the opening 47*a* overlaps the openings 26*a* as shown in FIG. 7B, all of the toner held in the smaller chamber 26 immediately falls from the smaller chamber 26 into the hopper 5 through the openings 26*a* and 47*a*.

Upon power up, the image forming apparatus performs initial setup operations to become ready for printing. Thereafter, the agitator 19 is driven in slow rotation to deliver fractions of toner, held in the large chamber 27, into the hopper in succession. In other words, the toner is delivered little by little into the hopper only when a printing operation is being carried out and the remaining toner in the hopper reaches a certain level.

As described above, the third embodiment offers the same advantages as the first and second embodiments.

Fourth embodiment

{Construction}

Figure 8:
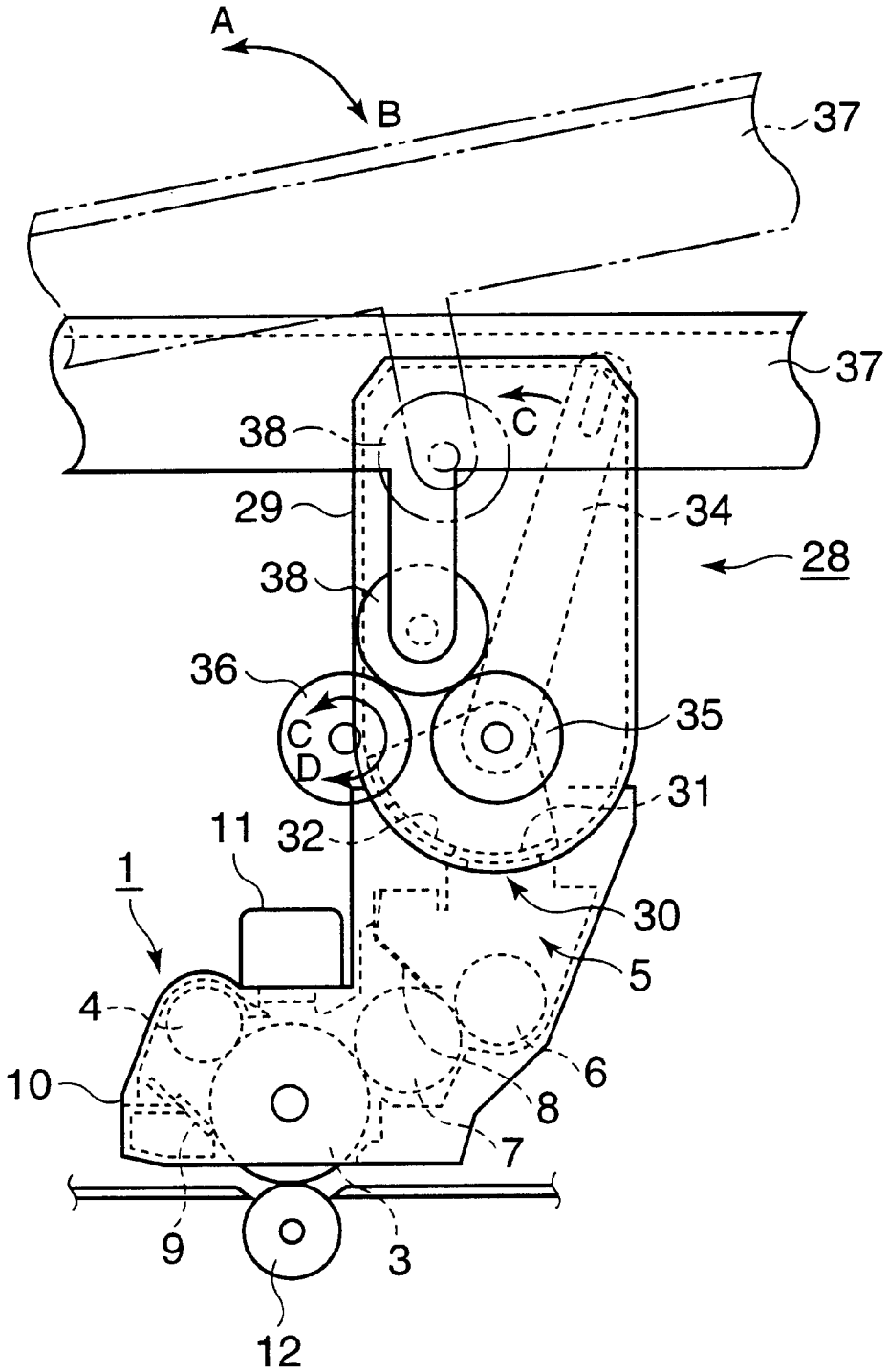
FIG. 8 is a cross-sectional side view illustrating a toner cartridge according to a fourth embodiment when the toner cartridge is attached to the developing unit.

FIG. 8 is a cross-sectional side view illustrating a toner cartridge according to a fourth embodiment when the toner cartridge is attached to the developing unit.

Figure 9:
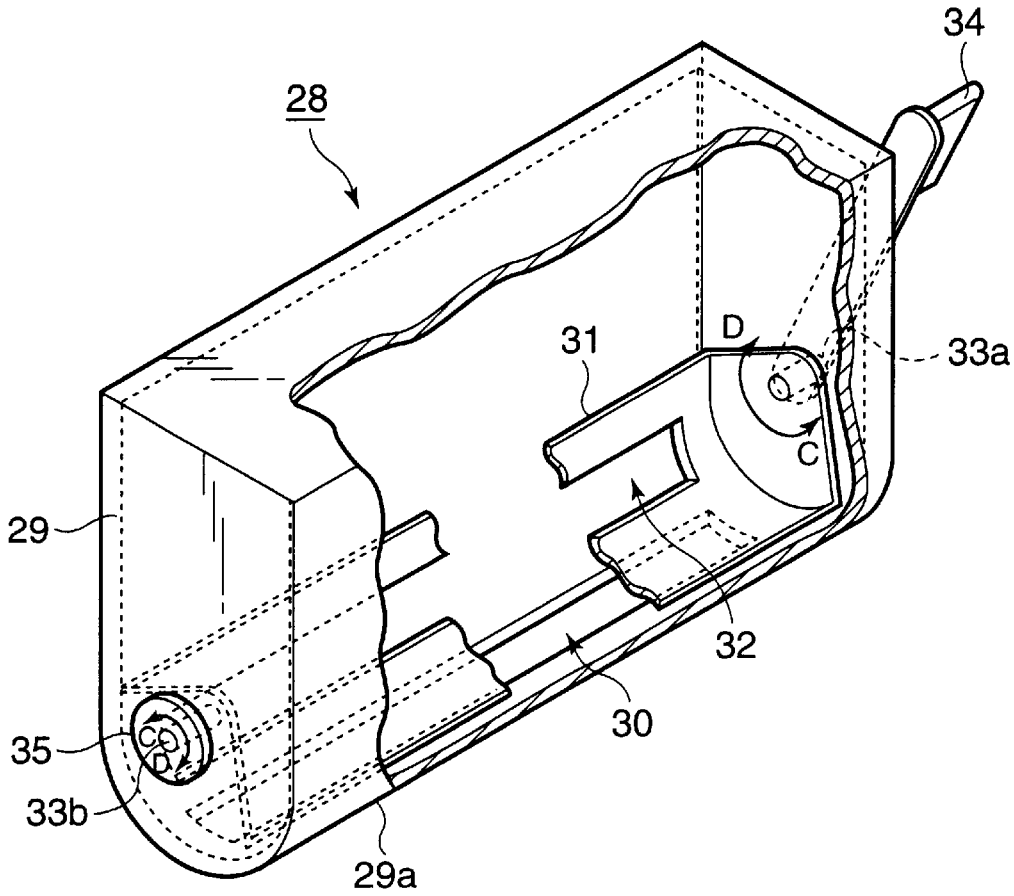
FIG. 9 is a perspective view of the toner cartridge of FIG. 8.

FIG. 9 is a perspective view of the toner cartridge.

FIGS. 8 and 9, a toner cartridge 28 has a generally hollow cylinder-shaped frame 29. The toner cartridge 28 has a single, large toner chamber as opposed to the first to third embodiments. The toner cartridge 28 has an opening 30 formed in a bottom portion 29*a* of the frame 29. The toner cartridge 28 discharges toner through the opening 30 into the hopper 5. The toner cartridge 28 has a shutter 31 with an opening 32 formed therein. When the shutter 31 rotates relative to the toner cartridge 28 such that at least a part of the opening 32 overlaps the opening 30, the toner falls from the toner cartridge 28 into the hopper 5.

The shutter 31 has short shafts 33*a* and 33*b* at longitudinal ends thereof. The shutter has shafts 33*a* and 33*b* that project outwardly from the shutter 31 in the longitudinal direction of the shutter 31. The short shafts 33*a* and 33*b* extend in opposite directions through the frame 29 and outwardly from the frame 29, and are rotatably supported by the frame 29. The shaft 33*a* is fixedly connected to a manual lever 34 and the shaft 33*b* is securely connected to a gear 35.

As shown in FIG. 8, there is provided a drive gear 36 on a body of the image forming apparatus. An idle gear 38 is rotatably mounted on an access cover 37 of the image forming apparatus such that when the access cover 37 is closed, the idle gear 38 moves into meshing engagement with the gear 35 and the drive gear 36. When the access cover 37 is opened, the idle gear 38 moves out of meshing engagement with the gears 35 and 36 as shown in dot-dot-dash lines. In other words, the idle gear 38 serves as a clutch that is engaged when the access cover 37 is closed and disengaged when the access cover 37 is opened.

The control system of the aforementioned image forming apparatus will be described. Here, the description focuses on the detection of remaining toner in the hopper 5 and control of the rotation of the shutter 31.

Figure 10:
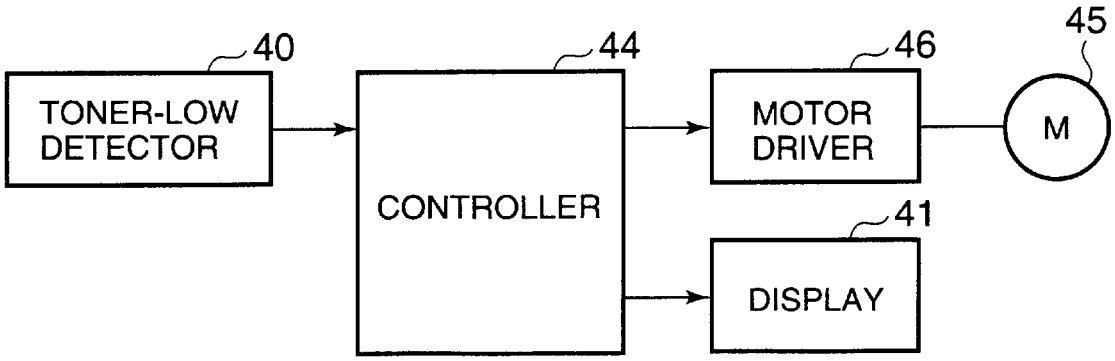
FIG. 10 is a block diagram illustrating a control system according to the fourth embodiment.

FIG. 10 is a block diagram illustrating the control system according to the fourth embodiment.

Referring to FIG. 10, the image forming apparatus has a controller 44 that controls the overall operation of the image forming apparatus.

A toner-low detector 40 detects the remaining toner in the hopper 5. When the remaining amount of toner is less than a threshold value (i.e., "toner-low" condition), the toner detector 40 generates a toner-low signal. When the controller 44 receives the toner-low signal for a certain length of time, the controller 44 determines that the toner in the toner cartridge has been exhausted, and causes a display 41 to prompt the user to replace the toner cartridge 28.

A stepping motor 45 is connected to the drive gear 36. A motor driver 46 is capable of driving the stepping motor 45 to rotate either in the forward direction or in the reverse direction in accordance with the signal received from the controller 44. The controller 44 and motor driver 46 cooperate to control rotation of the drive gear 36 to either open or close the shutter 31. When the controller 44 receives the toner-low signal, the stepping motor 45 rotates in such a direction as to open the shutter 31. When the controller 44 does not receive the toner-low signal, the stepping motor 45 rotates in such a direction as to close the shutter 31. A plunger magnet may be used in place of the stepping motor 45. The rest of the construction is much the same as the first embodiment.

{Operation}

The toner-discharging operation of the toner cartridge 28 will be described.

When the toner-low condition is detected, a display 41 indicates to the user that the toner cartridge 28 has reached exhaustion, and prompts the user to replace the toner cartridge 28. The user rotates the access cover 37 of the image forming apparatus in a direction shown by arrow A as shown in FIG. 8 and then replaces the toner cartridge 28. Likewise, when the user attaches a new, unused toner cartridge 28 to the image forming apparatus for the first time, the user also attaches the toner cartridge 28 in the same manner.

Then, the user rotates the lever 34 in a direction shown by arrow C to an opening position where the opening 31 formed in the shutter 31 is aligned with the opening 30. Thus, the toner in the toner cartridge cascades into the hopper 5 through the openings 30 and 31 to fill up the hopper 5. The toner filling up the hopper is enough for immediate printing operations. Toner that fills up the hopper 5 is not detrimental because printing has not begun yet.

Then, when the user closes the access cover 37 by rotating the access cover 37 in a direction shown by arrow B shown in FIG. 8, the idle gear 38 moves into meshing engagement with the drive gear 36 and gear 35. Upon power up, a startup operation takes place. That is, a series of preparatory operations are performed such as heating a heat roller, not shown, so that the image forming apparatus becomes ready for printing. If the toner-low detector 40 does not detect the toner-low condition during the start-up operation, the controller 44 causes the motor driver 46 to control the stepping motor 45, thereby driving the drive gear 36 to rotate in a direction shown by arrow D.

The rotation of the drive gear 36 in the direction shown by arrow D causes the shutter 31 to completely close the opening 30. Thus, the opening 32 formed in the shutter 31 no longer overlaps the opening 30, so that the toner is not discharged from the toner cartridge into the hopper 5. Then, the image forming apparatus is now ready for printing. Because the toner is not discharged into the hopper 5 when a printing operation starts, the hopper 5 will not receive toner from the toner cartridge 28 during the printing operation.

After many times of printing operations, either continuously or intermittently, if the toner-low detector 40 detects the toner-low state, the toner-low detector 40 provides a toner-low signal to the controller 44.

As long as the controller 44 receives the toner-low signal from the toner-low detector 40, the controller 44 continues to cause the motor driver 46 to control the stepping motor 45, thereby rotating the drive gear 36 in the direction shown by arrow C. The drive gear 36 causes the idle gear 38 to rotate, which in turn causes the gear 35 to rotate in the direction shown by arrow C of FIG. 9. The gear 35 causes the shutter 31 to rotate in the direction shown by arrow C such that at least a part of the opening 32 overlaps the opening 30, thereby discharging the toner.

As soon as the toner-low detector 40 stops providing the toner-low signal to the controller, the controller 44 causes the motor driver 46 to control the stepping motor to rotate in the direction shown by arrow D in FIG. 9, thereby not discharging the toner. It is to be noted that the operation of replenishing toner is carried out when a printing operation is not being carried out.

Thus, the toner in the toner cartridge 28 falls into the hopper 5 so that a fraction of toner is discharged into the hopper. When the toner-low detector 40 no longer detects the toner-low condition, the toner-low detector 40 immediately stops outputting the toner-low signal to the controller 44. Then, the controller 44 quickly causes the motor driver 46 to control the stepping motor 45, thereby causing the drive gear 36 to rotate in the direction shown by arrow D shown in FIG. 9 so that the shutter 31 rotates in the direction shown by arrow D. As a result, the opening 32 no longer overlaps the opening 30 and the supply of toner stops immediately. The aforementioned opening and closing operations of the shutter 31 is controlled until the toner cartridge 28 reaches exhaustion.

Just as in the first embodiment, a predetermined sufficient amount of toner is immediately discharged for immediate printing operations when the toner cartridge 28 is replaced or toner is discharged to the image forming apparatus for the first time. This way of discharging toner provides an easy-to-use image forming apparatus. The invention prevents an excess amount of toner from being discharged into the hopper 5 during printing, preventing the toner pressure in the hopper 5 from increasing more than necessary. Thus, the invention provides a reliable image forming apparatus in which printing results are prevented from being deteriorated.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed:

1. A toner cartridge removably attachable to a printer, the toner cartridge for discharging a toner into a toner hopper of the printer, the toner cartridge comprising:

a first toner chamber; and a second toner chamber, wherein said first toner chamber and said second toner chamber discharge the toner into the toner hopper, at least one of said first toner chamber and said second toner chamber discharging the toner by a substantially controlled amount into the toner hopper, wherein said first toner chamber has an opening through which the toner is discharged from said first toner chamber into the toner hopper and a closing member that closes the opening to prevent the toner from spilling from said first and second toner chambers at least when the toner cartridge is not attached to the printer.

2. The toner cartridge according to claim 1, wherein said first toner chamber holds a first amount of toner and said second toner chamber holds a second amount of toner.

3. The toner cartridge according to claim 1, wherein said second toner chamber discharges the toner through said first toner chamber into the toner hopper.

4. The toner cartridge according to claim 1, wherein said first toner chamber and said second toner chamber are disposed adjacent to each other.

5. The toner cartridge according to claim 1, wherein said first toner chamber has a first volume and said second toner chamber has a second volume.

6. The toner cartridge according to claim 1, wherein when the toner is discharged into the toner hopper for a first time after the toner cartridge has been attached to the printer, said first toner chamber discharges all of the toner held therein into the toner hopper;

wherein when the toner is discharged into the toner hopper after said first toner chamber has discharged the toner into the toner hopper, said second toner chamber discharges fractions of the toner a plurality of times into the toner hopper.

7. The toner cartridge according to claim 6, wherein said second toner chamber is disposed directly over said first toner chamber and discharges the toner through said first toner chamber into the toner hopper.

8. The toner cartridge according to claim 6, wherein said first toner chamber and said second toner chamber are disposed adjacent to each other.

9. The toner cartridge according to claim 6, wherein said first toner chamber holds a smaller amount of toner than said second toner chamber.

10. The toner cartridge according to claim 6, wherein said first toner chamber has a first toner discharging opening through which the toner is discharged into the toner hopper, and said second toner chamber has a second toner discharging opening at which a toner-discharging mechanism is disposed, wherein said toner-discharging mechanism operates to gradually discharge the fractions of the toner in succession into the toner hopper.

11. The toner cartridge according to claim 10, wherein said toner-discharging mechanism has a third toner discharging opening formed therein;

wherein when said toner-discharging mechanism is at a first position relative to the toner cartridge, at least a part of the third toner discharging opening overlaps said second toner-discharging opening so that the toner is discharged from the second toner chamber into the toner hopper through the second toner discharging opening and said third toner-discharging opening;

wherein when said toner-discharging mechanism is at a second position relative to the toner cartridge, said toner-discharging mechanism does not allow the toner to be discharged into the toner hopper through said second toner-discharging opening and said third toner discharging opening.

12. The toner cartridge according to claim 1, wherein said first toner chamber and said second toner chamber are in one piece construction.

13. The toner cartridge according to claim 1, wherein the closing member is a shutter, the shutter being opened after the toner cartridge has been attached to the printer.

14. The toner cartridge according to claim 13, wherein said first toner chamber and said second toner chamber have a common shutter, wherein when the shutter opens, said first toner chamber and said second toner chamber discharge the toner into the hopper.

15. A toner cartridge having a toner chamber that holds toner therein, the toner cartridge being removably attachable to a printer and discharging the toner into a toner hopper of the printer, the toner cartridge comprising:

a toner-discharging opening through which the toner is discharged from the toner chamber into the toner hopper; and a toner agitator disposed at said toner-discharging opening, said toner agitator operating to allow and not to allow the toner to be discharged from the toner chamber through the toner-discharging opening into the toner hopper, wherein when said toner agitator allows the toner to be discharged, said toner agitator rotates to agitate the toner held in the toner chamber, wherein said toner agitator has a toner-holding recess formed therein that alternately faces an inner space of the toner chamber and an inner space of the toner hopper as said toner agitator rotates, wherein when the toner-holding recess faces the inner space of the toner chamber, an amount of the toner is received in the toner-holding recess; and wherein when the toner-holding recess faces the inner space of the toner hopper, an amount of the toner moves from the toner-holding recess into the toner hopper.

16. A printer apparatus having a toner hopper for receiving toner therein, comprising:

a printer; and a toner cartridge, wherein the toner cartridge includes a toner-discharging opening through which the toner is discharged into the toner hopper; and a shutter disposed at said toner-discharging opening and having an opening formed therein, said shutter being movable relative to the toner cartridge between a first position where at least a part of the opening overlaps said toner-discharging opening and a second position where said shutter closes said toner-discharging opening, wherein the printer includes a controller that controls said shutter to allow the toner to be discharged into the toner hopper only when an amount of toner remaining in the toner hopper is below a threshold value and a printing operation is being performed; and a detector that generates a signal indicating that the amount of toner is below the threshold value, wherein said controller controls said shutter to allow the toner to be discharged only when said controller is receiving the signal.

17. The toner cartridge according to claim 16, wherein the toner cartridge further includes a first toner chamber and a second toner chamber, said first toner chamber having a smaller volume than said second toner chamber.

18. The printer apparatus according to claim 16, wherein said controller controls said shutter to allow the toner to be discharged by an amount of toner into the toner hopper in accordance with a total amount of printed data after the toner is discharged last time.

19. The printer apparatus according to claim 16, wherein the toner cartridge further includes a drive mechanism that causes said shutter to move between the first position and the second position; and wherein said controller controls said drive mechanism such that said shutter moves to the first position when the signal is smaller than a threshold value and to the second position when the signal is greater than the threshold value.

20. The printer apparatus according to claim 19, wherein the printer further includes a clutch mechanism;

wherein when said clutch mechanism is engaged, said controller controls said drive mechanism; and wherein when said clutch mechanism is disengaged, said controller does not control said drive mechanism.

* * * * *